US006123597A

United States Patent [19]

Matthews et al.

[11] Patent Number: 6,123,597

[45] Date of Patent: Sep. 26, 2000

[54] YOYO PROTECTIVE SLEEVE

[76] Inventors: Donald Scott Matthews, 4450 Shade Rd., La Mesa, Calif. 91941; William Brian Dunn, 1034 Mary St., El Cajon, Calif. 92021

[21] Appl. No.: 09/252,621

[22] Filed: Feb. 16, 1999

[51] Int. Cl.[7] ..... A63H 1/30

[52] U.S. Cl. ..... 446/250; 206/315.1

[58] Field of Search ..... 446/247, 248, 446/250–252; 2/59; 473/607; 224/919; 206/315.1, 315.9, 407

[56] References Cited

U.S. PATENT DOCUMENTS

| | | | |
|---|---|---|---|
| 2,257,252 | 9/1941 | Vorbusch | 473/607 |
| 2,605,584 | 8/1952 | Perker et al. . | |
| 3,895,457 | 7/1975 | Koskiewicz | 446/250 |
| 4,207,701 | 6/1980 | Kuhn | 446/250 |
| 4,632,245 | 12/1986 | Lerner . | |
| 5,064,107 | 11/1991 | Ascarrunz | 224/247 |
| 5,763,796 | 6/1998 | Britto et al. | 84/95.2 |
| 5,769,686 | 6/1998 | Duncan et al. | 446/250 |
| 5,772,090 | 6/1998 | Rodriguez | 224/251 |
| 5,775,530 | 7/1998 | Attaway | 220/4.22 |
| 5,839,577 | 11/1998 | Friedler | 206/315.1 |

*Primary Examiner*—D. Neal Muir

*Attorney, Agent, or Firm*—Henri J. A. Charmasson; John D. Buchaca

[57] ABSTRACT

A protective sleeve for a yoyo toy is made of resiliently stretchable material. The sleeve is coaxially engaged over the yoyo when not in use. The sleeve, not only protects the yoyo against chips, scratches and other damages, but also keeps its string from unraveling or tangling.

5 Claims, 1 Drawing Sheet

YOYO PROTECTIVE SLEEVE

FIELD OF THE INVENTION

This invention relates to protective containers such as bags, pockets, fobs, and more particularly to protective containers for small items such as delicate toys and precious objects.

BACKGROUND OF THE INVENTION

Yoyos, those perennial toys imported from the Philippines years ago are benefiting from a new wave of popularity among adults and children. High tech materials and clever designs are now used to create a great diversity of very attractive and sometimes quite expensive yoyos. When not in use and carried in clothes pockets and bags, the glove compartment of one's car, or left among the clutter of one's desk drawer, yoyos be subject to scratches, chips and other abrasions and to dirt and dust contaminating internal mechanisms. Moreover, the string, if not carefully coiled and cinched, tends to unravel or become hopelessly tangled in knots and be exposed to abrasions and premature wear.

It has been a common practice to use a rubber band to hold the string coiled. However, rubber bands are usually too narrow to properly secure the string, and must be stretched to form several layers around the string coils. Removing such a rubber band tightly ensconced in the groove of the yoyo can be problematic.

This invention results from efforts to find a more practical way to secure and protect the yoyo.

SUMMARY OF THE INVENTION

The principal and secondary objects of this invention are to provide a protective housing for a yoyo that can firmly hold the coiled string in place and yet be quickly and conveniently installed or removed.

These and other valuable objects are achieved by a sleeve made of resiliently stretchable material and having an inside diameter slightly smaller than the outer diameter of the yoyo.

DESCRIPTION OF THE PREFERRED EMBODIMENT OF THE INVENTION

Figure 1:
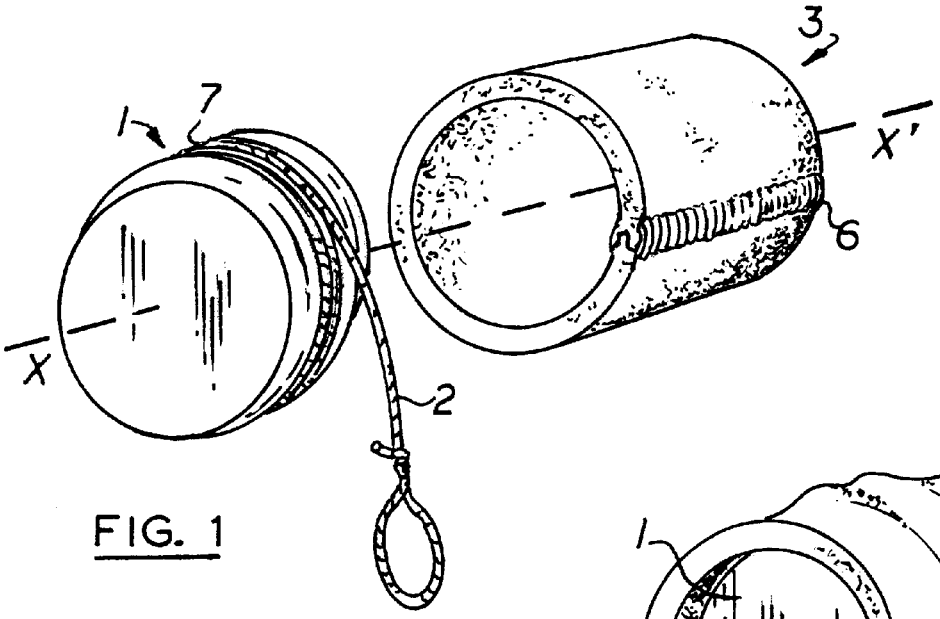
FIG. 1 is a perspective and exploded view about axis X—X' of a yoyo and its protective sleeve according to the invention.
Figure 2:
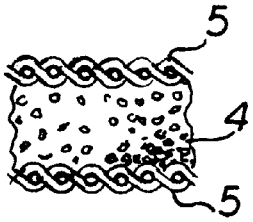
FIG. 2 is a cross-sectional view of a swatch of a type of material used in the fabrication of the sleeve.
Figure 3:
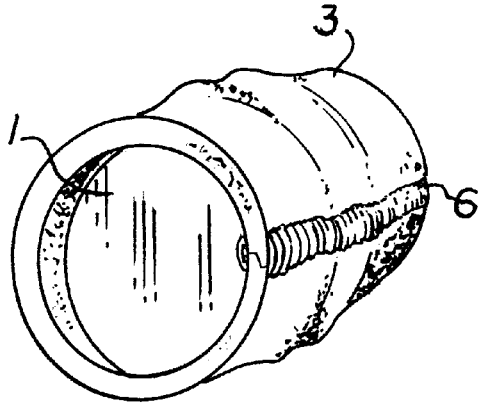
FIG. 3 is a perspective view of a yoyo ensconced in its protective sleeve.

Referring now to the drawing, there is shown a conventional yoyo toy 1 with its string 2 fully coiled. A tubular sleeve 3 made of resiliently stretchable material has an internal diameter which is slightly lesser than the outer maximum diameter of the yoyo. The length of the sleeve is approximately three times the axial width of the yoyo. In the preferred embodiment of the invention, the material used for the sleeve is a layer of elastomeric foam such as a neoprene, coated on both sides by a woven nylon fabric 8. Alternately, the inner layer 8 may be omitted or otherwise treated to increase friction between the yoyo and sleeve discouraging accidental extraction. The overall thickness of the sleeve material is approximately 7.5 millimeters (0.3 inches). It should be understood that other stretchable materials could be used such as a knitted fabric of wool yarn. The sleeve is formed by coiling a swatch of material upon itself and joining opposite edges by stitching 6. When the sleeve 3 is slightly stretched and coaxially engaged over the yoyo 1, it forms a protective cocoon as illustrated in FIG. 3. It should be noticed that the extra material at both axial ends of the sleeve provide effective bumpers against denting or scratching the lateral surfaces of the yoyo and protects against the entry of foreign materials such as dirt and dust. The sleeve also keeps the coiled string 2 tightly and safely in place within its groove 7. The yoyo can be conveniently extracted from the sleeve by pushing against one of its faces with the thumbs while the index finger coils back the opposite ends of the sleeve.

While the preferred embodiment of the invention has been described, modifications can be made and other embodiments may be devised without departing from the spirit of the invention and the scope of the appended claims.

What is claimed is:

1. The combination of a yoyo, having a substantially round body of a given overall diameter and a given axle thickness, an axle for the yoyo and including a string coiled around said axle, with a protective tubular sleeve made of stretchable material; said sleeve open at both ends, said sleeve having an inside diameter slightly smaller than said overall diameter and an axle length longer than said thickness.

2. The combination of claim 1, wherein said sleeve is made of elastomeric material.

3. The combination of claim 1, wherein said sleeve is made from a knitted fabric.

4. The combination of claim 2, wherein said sleeve comprises a first layer of synthetic foam and at least one second layer of woven fabric bonded to said first layer.

5. The combination of claim 4, wherein said synthetic foam layer is made of neoprene.

* * * * *